US007396267B1

(12) United States Patent
Parker

(10) Patent No.: US 7,396,267 B1
(45) Date of Patent: Jul. 8, 2008

(54) WATERCRAFT ROWING FIN SYSTEM

(76) Inventor: Jack W. Parker, P.O. Box 1061, Snoqualmie, WA (US) 98065

( * ) Notice: Subject to any disclaimer, the term of this patent is extended or adjusted under 35 U.S.C. 154(b) by 0 days.

(21) Appl. No.: 11/510,250

(22) Filed: Aug. 24, 2006

(51) Int. Cl.
*B63H 16/00* (2006.01)
*B63H 1/36* (2006.01)

(52) U.S. Cl. ..... 440/105; 440/15

(58) Field of Classification Search ..... 440/105
See application file for complete search history.

(56) References Cited

U.S. PATENT DOCUMENTS

| | | | | | |
|---|---|---|---|---|---|
| 871,059 | A | | 11/1907 | Douse | |
| 892,418 | A | | 7/1908 | Hallman | |
| 2,330,332 | A | | 9/1943 | Boon | |
| 2,696,797 | A | | 12/1954 | Whidden | |
| 2,873,713 | A | | 2/1959 | Baastrup | |
| 2,875,723 | A | | 3/1959 | Moore | |
| 3,086,492 | A | | 4/1963 | Holley | |
| 3,110,283 | A | * | 11/1963 | Warner | 440/15 |
| 3,297,283 | A | | 1/1967 | Knaver | |
| 3,677,216 | A | | 7/1972 | Gentemann | 115/24.1 |
| 3,855,957 | A | | 12/1974 | Gross | 226/28 |
| 4,345,903 | A | | 8/1982 | Laser | 440/14 |
| 4,892,493 | A | | 1/1990 | Gil | 440/17 |
| 5,021,015 | A | * | 6/1991 | Wang | 440/13 |
| 5,364,296 | A | | 11/1994 | Cerny | 440/101 |
| 5,975,004 | A | * | 11/1999 | Nesseth | 114/347 |
| 6,193,466 | B1 | | 2/2001 | Earl | 416/129 |
| 6,755,706 | B1 | | 6/2004 | Lin | 440/101 |
| 6,843,691 | B1 | | 1/2005 | Jelten | 440/15 |

* cited by examiner

*Primary Examiner*—Jesús D Sotelo
(74) *Attorney, Agent, or Firm*—Dean A. Craine

(57) ABSTRACT

A rowboat roving fin system that includes two rotating fin assemblies mounted on the watercraft's opposite sidewalls. Each fin assembly includes a rotating vertical post held on the outside surface of the sidewall by a mounting bracket. When held by the mounting bracket, the upper end of the post extends above the gunwale while the lower end of the post extends below the mounting bracket. In a first embodiment, a pivoting fin arm with a flexible fin attached thereto is pivotally attached to the lower end of each post via a stop hinge. The stop hinge acts to limit the rotating of the fin arm along a vertical arc around the lower end of the post. The fin is perpendicularly aligned and attached to the fin arm. Attached to the upper end of each post that extends near the gunwale is a perpendicularly aligned handle bracket. The handle bracket is perpendicularly aligned with the post and with the rotation arc of the fin arm. A rowing handle is pivotally attached at one end to the handle hinge. During use, the two handles extend inward from the sidewall and are grasped by the rower. Both handles are able to swing in a vertical 180° degree arc over their respective handle hinges thereby allowing the fins to rotate 180° degrees and sweep in opposite directions.

10 Claims, 6 Drawing Sheets

WATERCRAFT ROWING FIN SYSTEM

BACKGROUND OF THE INVENTION

1. Field of the Invention

The invention disclosed herein pertains to manual propulsion systems for a small watercraft and more particularly to manual rowing systems used on small watercraft.

2. Description of the Related Art

Any small watercraft propelled by oars is called a rowboat or skiff. When such boats are used to service a larger watercraft such as a yacht or motor cruiser, they are called a dinghy or tender.

Conventional rowboats include oarlock sockets mounted to the gunwales on the opposite sides of the hull. Attached to each oar is an oarlock that includes a post that slides downward and engages an oarlock socket that pivotally attaches the oar to the gunwale. The post, which is able to rotate freely inside the socket, may be easily lifted from the oarlock socket to remove the oars from the rowboat.

Rowing a rowboat is an acquired skill that is mastered only by practicing. The act of rowing involves fours steps: catching the water with each oar blade; driving and pulling each oar blade through the water; feathering each blade out of the water after reaching the end point of the stroke; and then lifting each blade from the water and repositioning it to the original starting point of the stroke. Because both arms are used when rowing, it is important that they move in a coordinated manner and apply a correct force so that the rowboat is propelled in a desired direction.

The oarlock sockets mounted on the gunwales are offset from the rowboat's midline axis and towards the stern. The rower typically sits in the center seat and rows with his or her back facing the bow. The rower then catches, drives and pulls the oars towards his or her chest to move the oar blades through the water. To turn the rowboat, the rower must manipulate the oars to create a turning force on the side opposite the turn. In order to row the rowboat in the opposite direction, the rower usually rotates the rowboat 180 degrees in the water so that the bow faces in the new direction.

SUMMARY OF THE INVENTION

It is an object of the present invention to provide an alternative rowing system for a small watercraft that does not use long oars that extend laterally from the port and starboard sides of the watercraft.

It is another object of the present invention to provide such a rowing system and allows the user to easily row in opposite directions without having to reposition him or herself in the watercraft.

It is another object of the present invention to provide such a rowing system that allows the rower to easily turn the watercraft.

These and other objects are met by a manual rowing fin system for a small watercraft, such as a rowboat, disclosed herein that includes two rotating fin assemblies mounted on the opposite sidewalls of the small watercraft. Each fin assembly includes a vertically aligned, rotating post disposed over the outside surface of the sidewall. The post is held in position on the sidewall by a mounting bracket affixed to the outside surface of the sidewall. In the first embodiment, the length of the post is sufficient to extend from the gunwale to a point just below the watercrafts' keel. The post is able to rotate freely 360 degrees around its vertical axis when attached to the mounting bracket.

In one embodiment, a pivoting fin arm with a flexible fin attached thereto is attached to the lower end of each post. The fin arm is able to rotate upward and downward in a vertical arc around the end of the post thereby allowing the fin attached thereto to be deflected up or down by objects in the water or folded into an upward retracted position against the sidewall when lifting the watercraft from the water. In this embodiment, a stop hinge is disposed between the end of the fin arm and to the lower end of the post, which limits the rotation of the fin arm to a 90 degree arc.

Securely attached to the upper end of each post is a perpendicularly aligned, fixed handle hinge. When properly assembled, the longitudinal axis of the handle hinge is perpendicularly aligned with the stop hinge's and the fin arm's longitudinal axis. Longitudinally aligned on the handle hinge is an elongated rowing handle. The rowing handle is pivotally attached at one end to the handle hinge and is able to swing 180 degrees in a vertical arc over the handle hinge. During use, the rower grasps the free ends of the two rowing handles attached to the opposite rowing assemblies and then sweeps them back and forth over 45 degree horizontal arcs over the open area of the watercraft. As the handles are swept back and forth along the arcs, the two fins move back and forth in the water in a 45 degree horizontal arc to propel the watercraft through the water. The rower is able to lift and rotate each handle in the 180 degree vertical arc over the handle hinge which allows the rower to change the direction of the fins in the water. Because the fins are located at a depth under the keel, then are able to freely rotate under the watercraft. The lifting and repositioning of the two handles and the 360 degree rotation of the fins allows the user to propel the watercraft in opposite directions without changing his or her position inside the watercraft.

DESCRIPTION OF THE PREFERRED EMBODIMENT(S)

Figure 1:
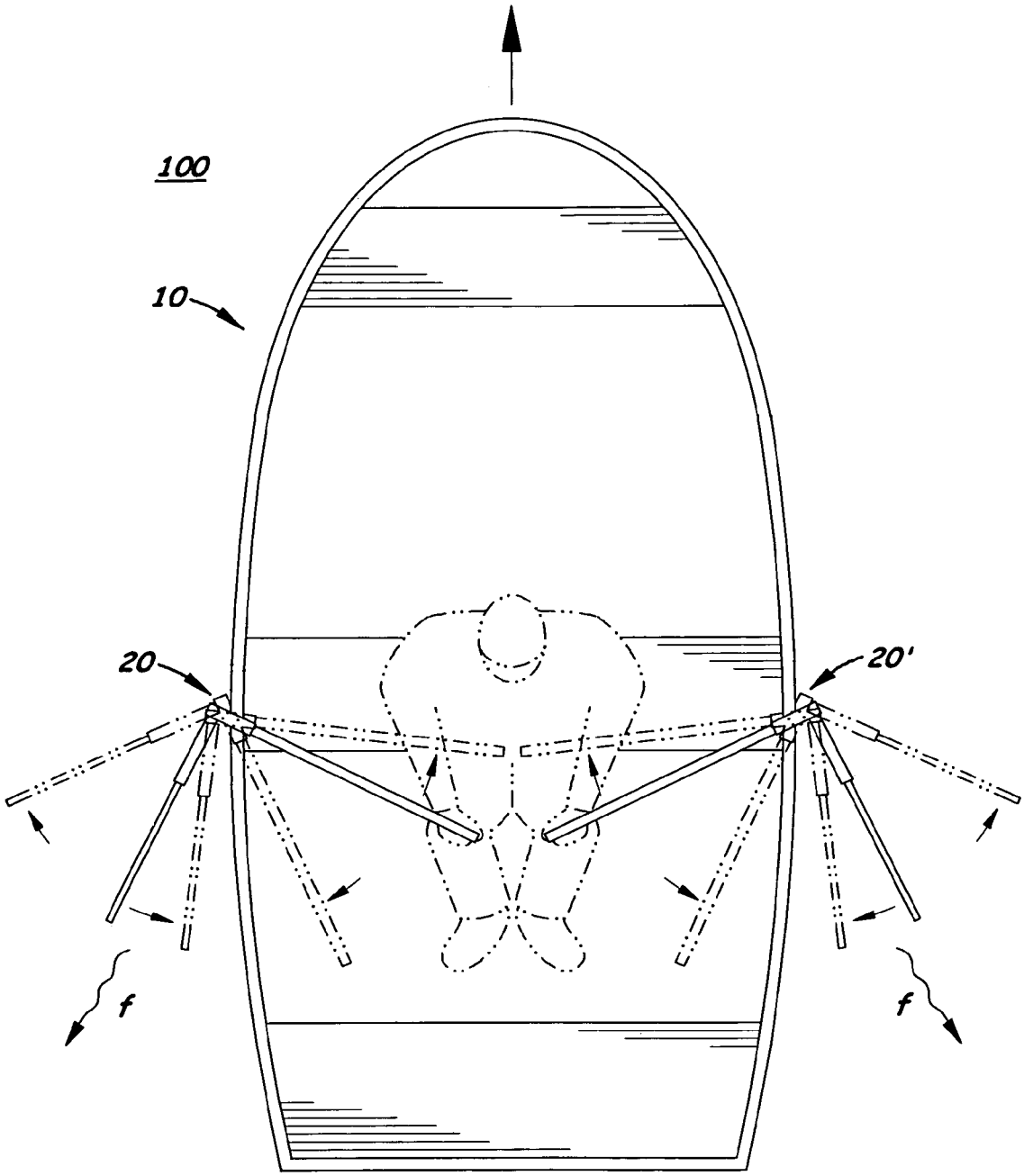
FIG. 1 is a top plan view of a manual rowing system mounted on opposite sides of a rowboat showing a rower rowing the rowboat in a forward direction.

Shown in the accompanying Figs. there is shown a manual rowing system 10 used by to propel a rowboat 12 in a body of water 100 comprised of two rotating fin assemblies 20, 20' mounted on the opposite sidewalls 14,16 of a rowboat 12. The two fin arm assemblies 20, 20' are easier to use than standard oars and allow the rower 95 to easily row the rowboat 12 in opposite directions while sitting in the same location inside the rowboat 12.

Each fin assembly 20, 20' includes a rotating post 30 disposed over the outside surface of the sidewall 14, 16 of the rowboat 12. The post 30 is sufficient in length so that its upper end 32 extends above the gunwale 15 and its lower end 33 extends into the water 100.

The post 30 is held in position on the sidewall 14 or 16 by a mounting assembly 40. Each mounting assembly 40 includes an upper bracket 45. The upper bracket 45 includes a vertical flange surface 47 that is placed against the outside surface of the sidewall 14, 16 and a horizontal flange surface 49 that fits over the top edge of the gunwale 15. Formed on the vertical flange surface 47 are holes 50, 52 through which suitable threaded screws 54, 56, respectively are inserted to attach the upper bracket 45 to the sidewall 14, 16. The mounting assembly 40 also includes the lower bracket 51 with a flat plate 53 with a beveled spacer 55 attached to its inside surface. Formed on the flat plate 53 and the spacer 55 are two pairs of holes 57, 59 through which suitable threaded screws 85, 87 are inserted to attach the lower bracket 51 to the boat's hull. Disposed between the upper bracket 45 and the lower bracket 51 is a vertically aligned, hollow tube 60 designed to receive the post 30 and allow it to rotate freely therein. In the first embodiment, the tube 60 is relatively short so that the lower end of the post 30 extends below.

Figure 4:
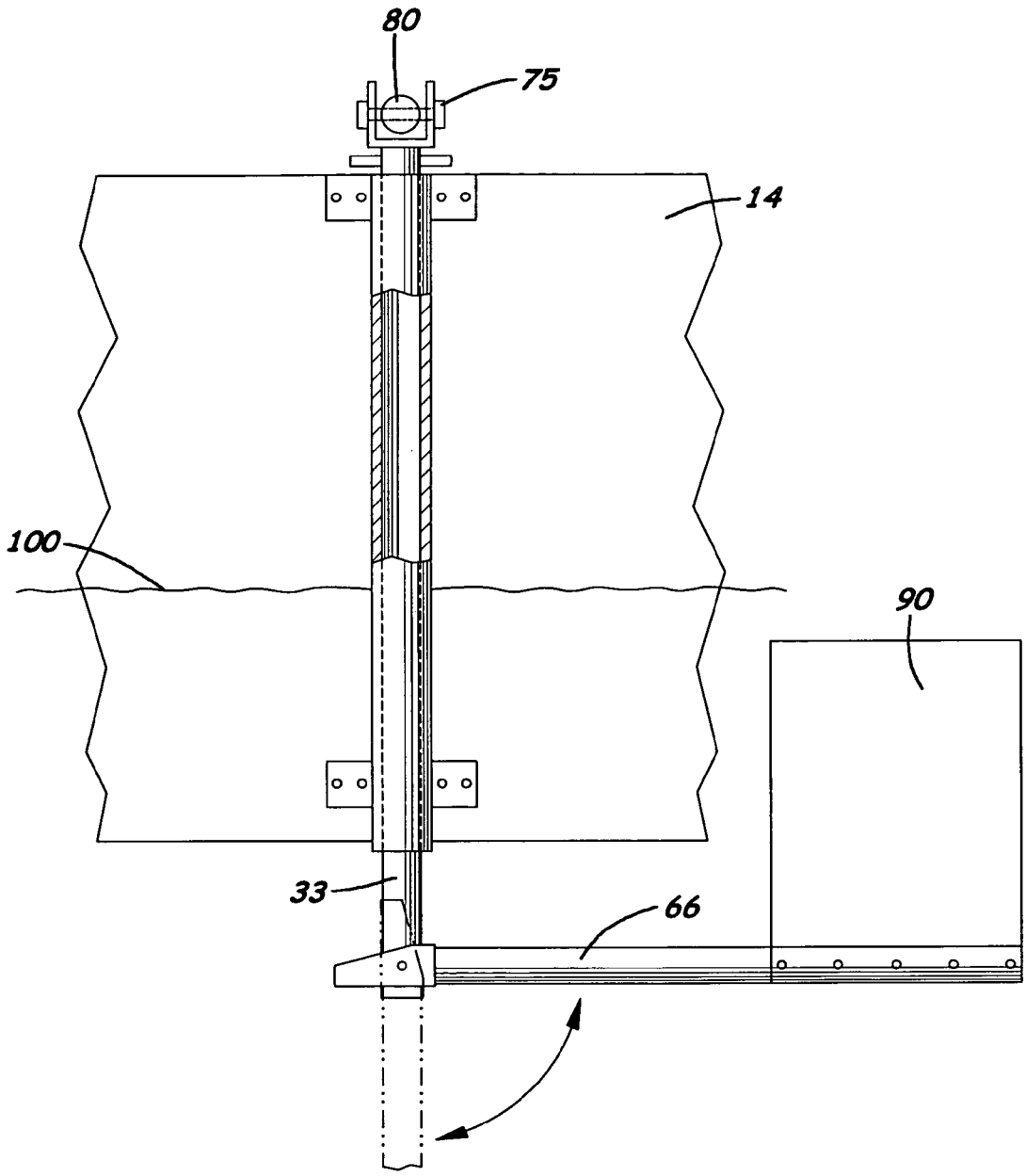
FIG. 4 is a side elevational view of the sidewall of a rowboat showing the post assembly placed inside the mounting bracket and the fin assembly attached to the end of the post and being deflected upward.
Figure 5:
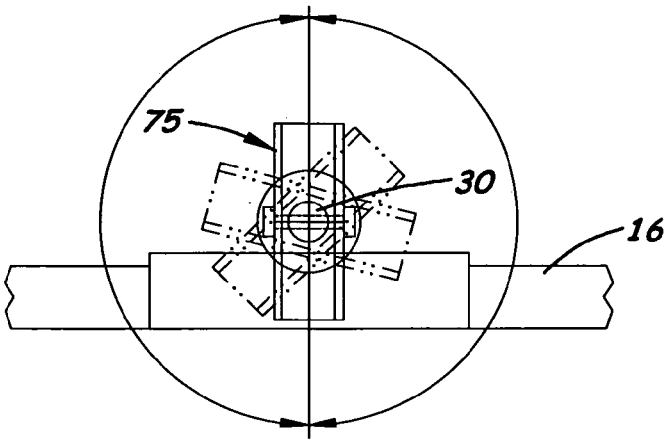
FIG. 5 is a top plan view of the handle bracket being rotated on the mounting bracket.
Figure 7:
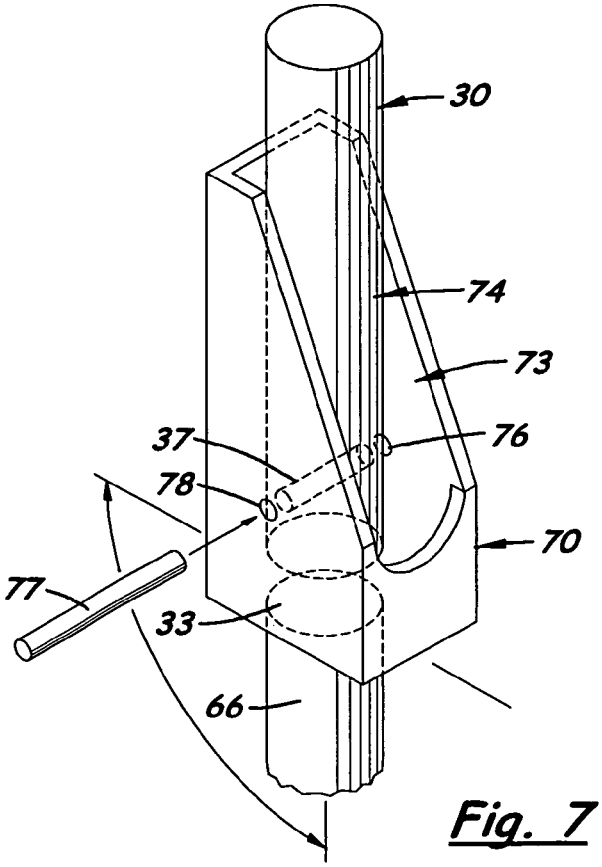
FIG. 7 is a perspective view of the lower end of a post extending through a stop hinge attached to the upper end of the fin arm.

As shown in FIG. 4, the fin arm assembly 20 includes a straight, rigid fin arm 66 with a flexible fin 90 attached to its distal end. In the first embodiment, a stop hinge 70 is attached or mounted to the proximal end of the fin arm 66. As shown in FIG. 7, the stop hinge 70 is a hollow elongated structure with a diagonal cut section formed in its upper section. Formed inside the stop hinge 70 is an elongated cavity 73 designed to receive the lower section of the post 30. A side opening 74 is formed on its stop hinge 70 through which the post 30 may extend when the fin arm 66 is rotated upward. Formed on the lower end of the stop hinge 70 are two transversely aligned bores 76, 78. A pin 77 is extended through the two bores 76, 78 and through a bore 37 formed on the post 30 to pivotally connect the stop hinge 70 to the post 30. The fin arm 66 is longitudinally aligned and securely attached at its upper end to the stop hinge 70.

The fin arm 66 is sufficient in length so that the top of the flexible fin 90 extends below the watercraft's keel. During use, the post 30, the fin arm 66 and the fin 90 are able to rotate freely as a unit 360 degrees. Also, the stop hinge 70 enables the fin arm 66 to rotate in a vertical arc over the lower end 33 of the post 30 thereby allowing the fin 90 to be deflected up or down by objects in the water 100 or folded into an upward retracted position against the sidewall 14, 16 when lifting the rowboat 12 from the water 100. As shown in FIG.

Figure 9:
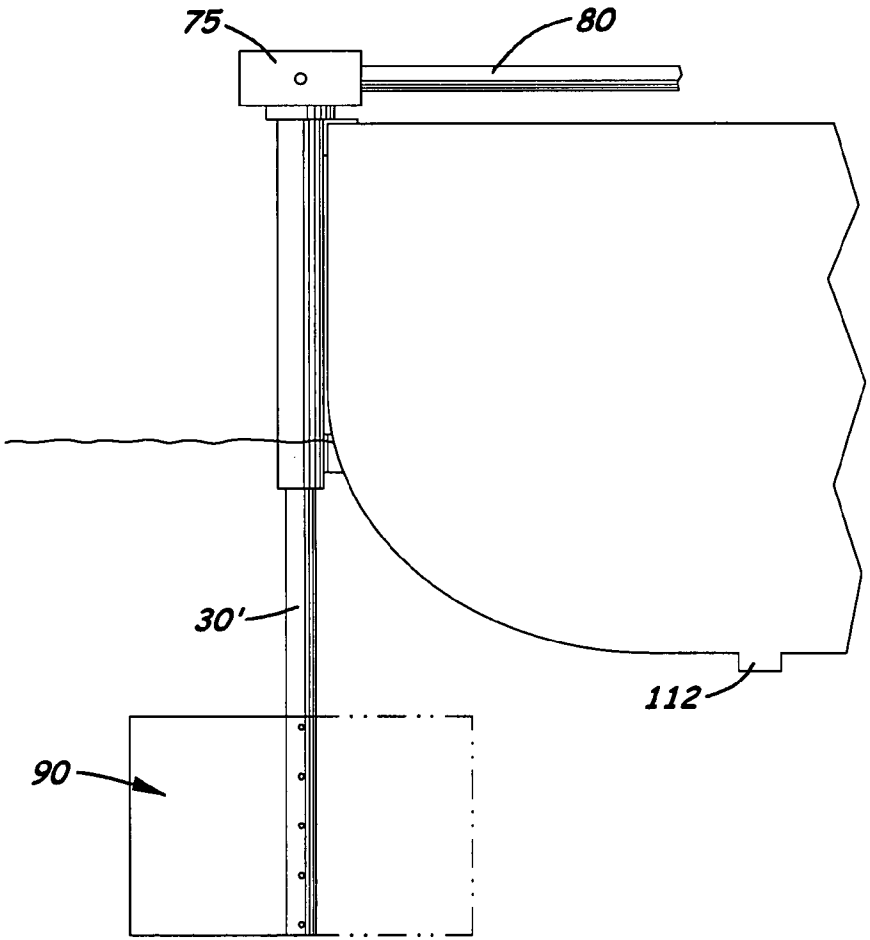
FIG. 9 is a front elevational view of the rowing system showing the relative location of the fin with respect to the keel.
Figure 8:
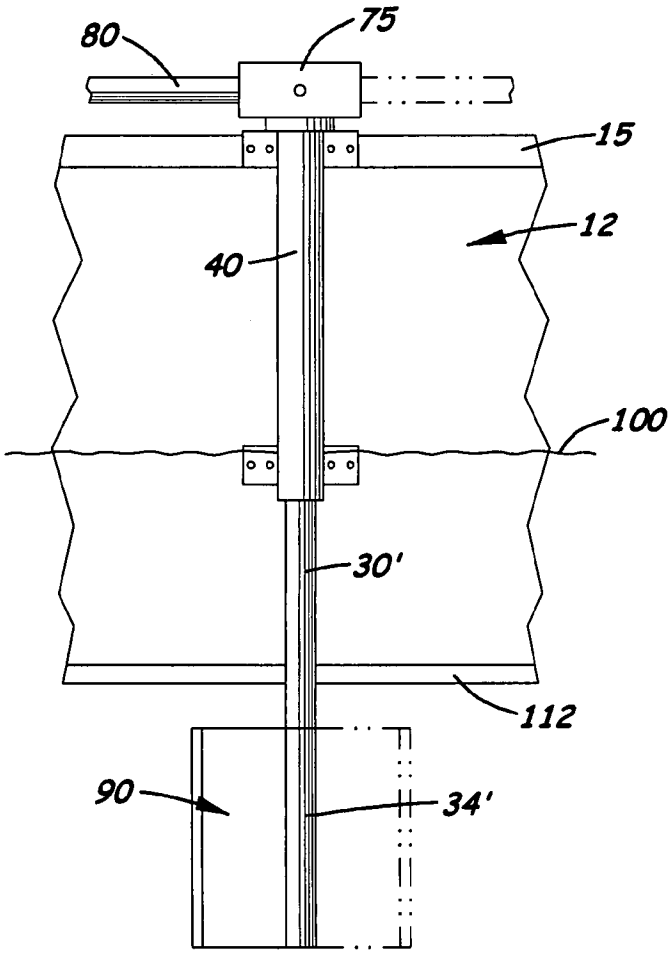
FIG. 8 is a side elevational view of a second embodiment of the rowing system showing the fin securely attached to the lower end of the post that extends below the keel.

FIGS. 8 and 9 show a second embodiment of the system, in which a longer post 30' is used in place of the first post 30, the stop hinge 70, and the fin arm 66. The fin 90 is perpendicularly aligned and attached along its front edge to the lower section 34' of the post 30'. The post 30' is sufficient in length so that the fin 90 extends below the keel 112 thereby allowing the fin 90 to rotate free 360 degrees.

The fin 90 is perpendicularly aligned and attached to the lower end of the fin arm 66 on second post 30'. In the preferred embodiment, the fin 90 is of flexible rubber or plastic.

Figure 3:
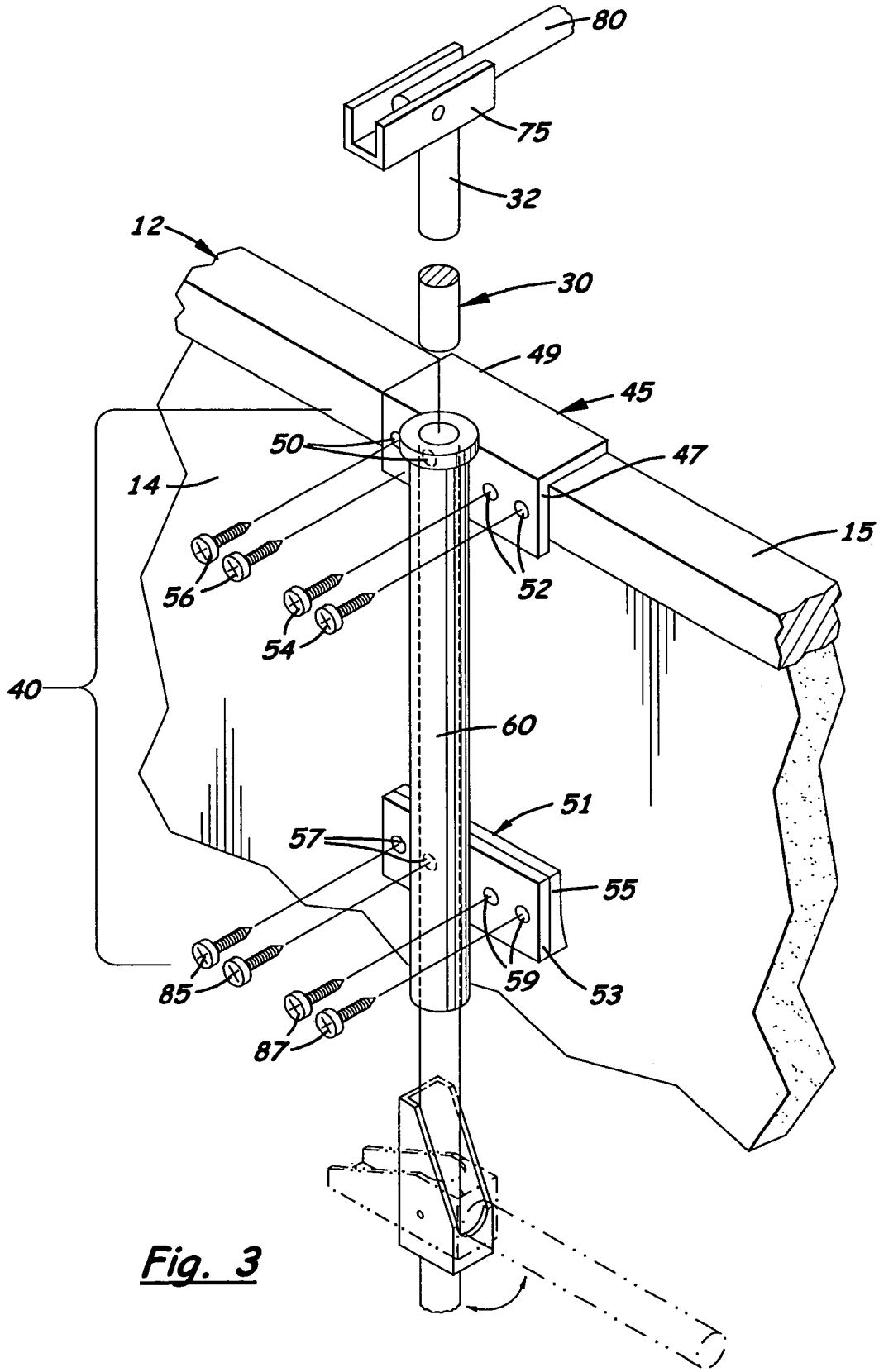
FIG. 3 is a perspective side view of the sidewall of a rowboat showing the mounting bracket attached thereto.

As shown in FIG. 3, attached to the upper end 32 of the post 30 is a handle hinge 75. In the preferred embodiment, the handle hinge 75 is an elongated, U-shaped structure perpendicularly mounted on the upper end 32 of the post 30.

Figure 2:
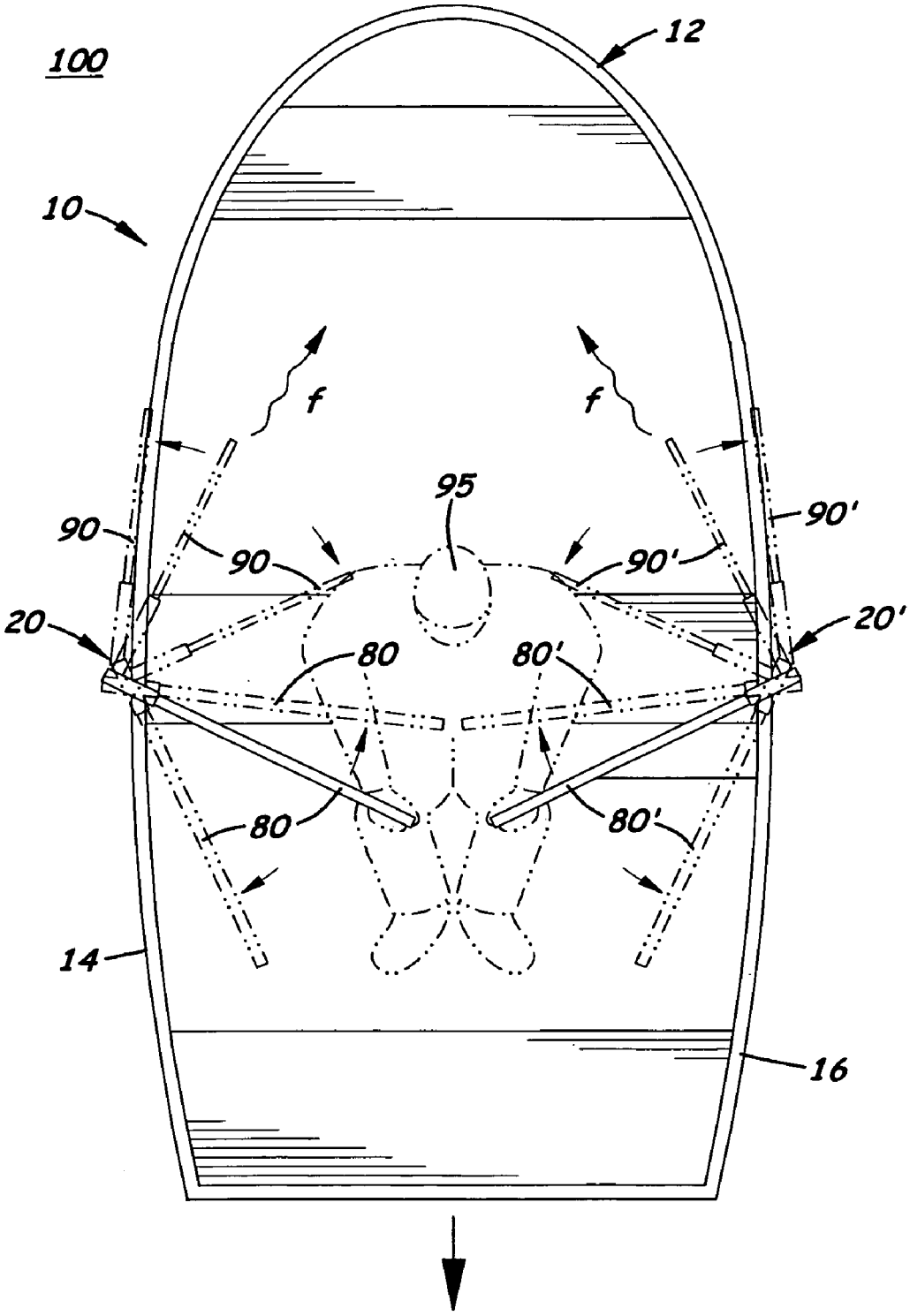
FIG. 2 is a top plan view of a rowboat shown in FIG. 1 showing the rower rowing the rowboat in a rearward direction.
Figure 6:
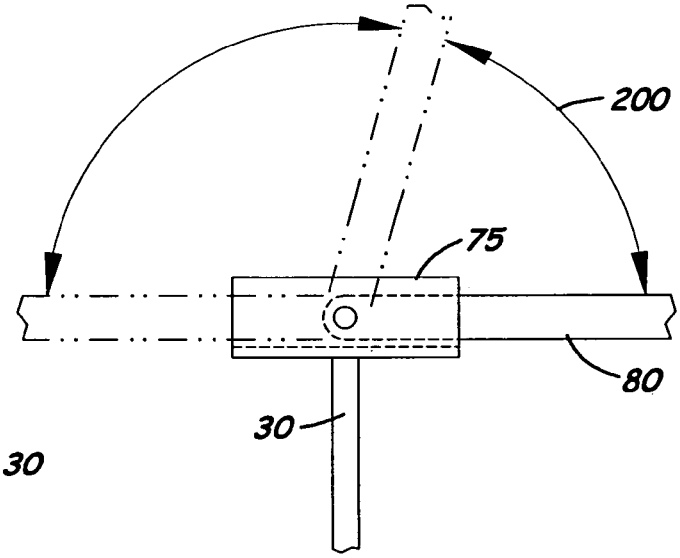
FIG. 6 is a side elevational view of the handle bracket with the handle being rotated 180 degrees over the handle bracket.

A rowing handle 80 is longitudinally aligned and attached at one end of the handle hinge 75. During use, the handle 80 extends inward and grasped by the rower 105. As shown in FIG. 6, the handle 80 is pivotally attached to the handle hinge 75 and is able to swing in a vertical 180 degree arc there over thereby allowing the rower 95 to sit in a normal rearward facing or forward facing direction and row in a forward direction as shown in FIG. 1, or in a reward facing direction as shown in FIG. 2.

In the preferred embodiment, the handle 80 is a hollow tube made of stainless steel and is approximately 24-36" in length and 1 inch in diameter. On the distal end of the handle 80 is an optional gripping sleeve made of rubber. The post 30 measures ¾ inch in diameter and 12-24 inches in length. The tube 60 measures 12-24 inches in length. The fin arm 66 that attaches to the post 30, measures 6-12 inches in length. The two fins 90, 90' are approximately 36-48 inches in length to 10 to 16 inches in width and have a tapered shape approximately 1½ inches thick in front and ¼ of an inch along the rear.

During use, the rower 95 grasps the free ends of the two rowing handles 80, 80' attached to the opposite rowing assemblies 20, 20', respectively, and then sweeps them back and forth in a 45 degree horizontal arc over the inside area of the hull. As the handles 80, 80' are swept back and forth along the arc, the two fins 90, 90' move back and forth in a 45 degree horizontal arc located in the water 100 and under the rowboat 12 to propel the rowboat 12 through the water 100. The rower 95 is able to lift and rotate each rowing handle 80, 80', in 180 degrees along a vertical arc (designated 200 in FIG. 6) over the handle hinge 75 and rotate the post 30 or 30', up to 360 degrees to change the orientation of the fins 90, 90' in the water 100 for propelling the rowboat 12 in the opposite direction without changing his or her position in the rowboat 12.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A small watercraft rowing fin system, comprising:

a. two rotating fin assemblies mounted on the opposite sidewalls of a watercraft, each said fin assembly including a rotating post disposed on over the outside surface of a sidewall of a watercraft, each said post including an upper end and a lower end, each said post being sufficient in length so that said upper end is located adjacent to the upper edge of the sidewall and said lower end extends into the water surface when the watercraft is placed therein;

b. a means for mounting each said post vertically on the outside surface of the sidewall;

c. a handle hinge securely mounted on the upper end of each said post;

d. a rowing handle attached at one end to each said handle hinge, said rowing handle capable of being extended inward and grasped by the user when rowing, said handle able to swing in a vertical 180 arc over said handle hinge thereby allowing the rower to sit in a rearward facing or a forward facing direction and row; and, e. a perpendicularly aligned fin attached to said lower section of each said post, said fin being oriented on said post so that as said handle is extended inward and moved in an arc back and forth over the watercraft, the fins move in an arc back and forth in the water to produce continuous propelling forces in the water.

2. The rowing fin system, as recited in claim 1, further including a stop hinge pivotally attached to said lower end of said post and a fin arm attached to said stop hinge disposed between said post and said fin.

3. The rowing fin system, as recited in claim 2, wherein said means for mounting said post on the sidewall of said watercraft is a mounting assembly that includes an upper bracket attached to the top edge of said sidewall, a lower bracket that attaches to outside surface of the sidewall, said lower bracket being vertically aligned with said upper bracket, and a vertically aligned hollow tube connected to said upper bracket and said lower bracket in which said post is inserted and able to rotate.

4. The rowing fin system, as recited in claim 2, wherein said fin is made of flexible material.

5. The rowing fin system, as recited in claim 2, wherein said handle hinge is an elongated U-shaped bracket.

6. The rowing system, as recited in claim 2, wherein said fin arm when longitudinally aligned with said post is sufficient in length so that said fin attached to said fin arm may be rotated under said watercraft.

7. The rowing fin system, as recited in claim 1, wherein said means for mounting said post on the sidewall of said watercraft is a mounting assembly that includes an upper bracket attached to the top edge of said sidewall, a lower bracket that attaches to outside surface of the sidewall, said lower bracket being vertically aligned with said upper bracket, and a vertically aligned hollow tube connected to said upper bracket and said lower bracket in which said post is inserted and able to rotate.

8. The rowing fin system, as recited in claim 1, wherein said fin is made of flexible material.

9. The rowing fin system, as recited in claim 1, wherein said post is sufficient in length so that said fin may be rotated under said watercraft.

10. The rowing fin system, as recited in claim 1, wherein said handle hinge is an elongated U-shaped bracket.

* * * * *